US005306003A

United States Patent [19]

Pagotto

[11] Patent Number: 5,306,003

[45] Date of Patent: Apr. 26, 1994

[54] HOCKEY STICK SHAFT

[75] Inventor: John Pagotto, Town of Mount-Royal, Canada

[73] Assignee: Tropsport Acquisitions Inc., Montreal, Canada

[21] Appl. No.: 910,512

[22] Filed: Jul. 8, 1992

[30] Foreign Application Priority Data

Jan. 4, 1992 [DE] Fed. Rep. of Germany ..... 9204465

[51] Int. Cl.[5] ..... A63B 59/12

[52] U.S. Cl. ..... 273/67 A; 273/73 J; 273/81 B; 273/72 R

[58] Field of Search ..... 273/67, 73 J, 72, 81 B, 273/81 R, 165, 81 D; 81/22

[56] References Cited

U.S. PATENT DOCUMENTS

| | | | |
|---|---|---|---|
| 2,201,263 | 7/1938 | Hall | 273/73 J |
| 3,109,653 | 11/1963 | Biggs | 273/81 B |
| 3,489,412 | 6/1967 | Franck et al. | 273/66 A |
| 3,934,875 | 1/1976 | Easton et al. | 273/67 A |
| 3,940,134 | 2/1976 | Bieganowski | 273/67 A |
| 4,052,499 | 10/1977 | Goupil et al. | 273/67 A |
| 4,172,594 | 10/1979 | Diederich | 273/67 A |
| 4,200,479 | 4/1980 | Ardell et al. | 273/67 A |
| 4,358,113 | 11/1982 | McKinnon et al. | 273/67 A |
| 4,361,325 | 11/1982 | Jansen | 273/67 A |
| 4,504,344 | 3/1985 | Helle et al. . | |
| 4,548,248 | 10/1985 | Riemann | 81/22 |
| 4,600,192 | 7/1986 | Adachi | 273/67 A |
| 4,796,889 | 1/1989 | Muraour | 273/73 J |

FOREIGN PATENT DOCUMENTS

| | | | |
|---|---|---|---|
| 1058240 | 7/1979 | Canada . | |
| 7214911 | 6/1972 | Fed. Rep. of Germany . | |
| 3238117A1 | 6/1983 | Fed. Rep. of Germany . | |
| 9232 | of 1913 | United Kingdom | 273/67 A |

*Primary Examiner*—Mark S. Graham
*Attorney, Agent, or Firm*—Ronald S. Kosie; Robert Brouillette

[57] ABSTRACT

The present invention, relates to a shaft or handle wherein the palm or upper side of the shaft has corner edges whose radius of curvature, at least in the grip area(s), is greater than the radius of curvature in the corresponding finger area(s); a hockey stick provided with such a handle may provide a sense of a better or more comfortable feel on the gripped portion of the handle and/or a sense of a more comfortable and precise control of a blade which may be fixed to the end of such a handle.

12 Claims, 1 Drawing Sheet

FIG. 1
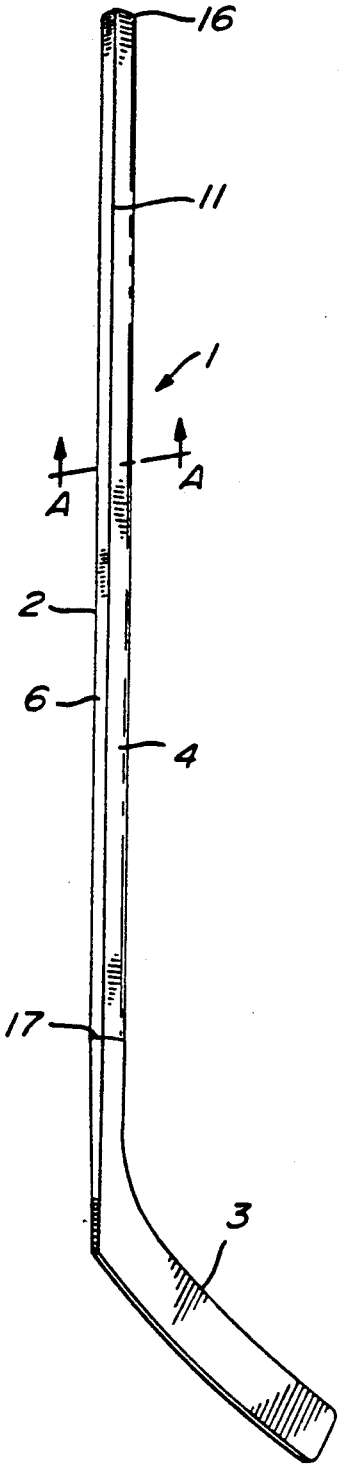
FIG. 2
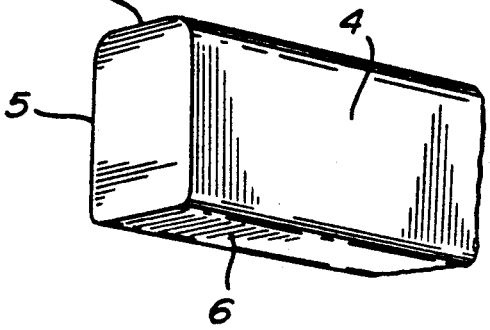
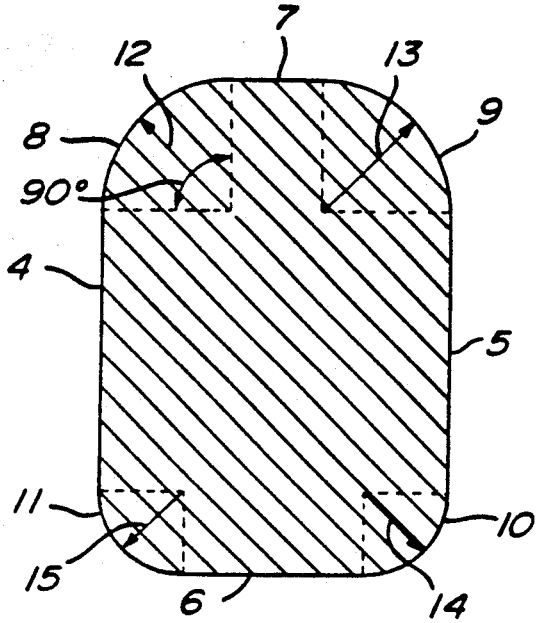
FIG. 3
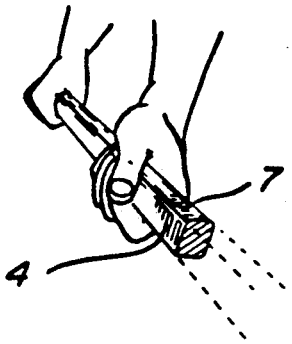
FIG. 4

HOCKEY STICK SHAFT

The present invention relates to game stick shafts and in particular to shafts or handles for use with hockey sticks or the like; such shafts include, for example, ice hockey sticks (including goalie sticks), street hockey sticks, ringuette sticks and the like. The present invention, by way of example only, will be described hereinafter in relation to an ice hockey stick.

Ice hockey sticks generally consist of two basic elements, namely an elongated handle component and a blade secured to the lower end of the handle. Hockey stick handles or shafts which have a more or less substantially rectangular cross-section are preferred by hockey players since such a shaft affords the user a relatively comfortable grip in addition to providing him with a certain degree of awareness of and control over the orientation of the blade at the end of the shaft.

However, it would be advantageous to have an elongated handle for a hockey stick or the like which may provide a sense of increased gripping comfort and/or control of the blade at the end of the handle.

SUMMARY OF THE INVENTION

Generally, in accordance with the present invention, there is provided an elongated handle of rectangular configuration, for a hockey stick or the like, said handle having, a pair of opposed broad side faces,
a pair of opposed narrow side faces,
a first convexly curved corner portion,
a second convexly curved corner portion,
a third convexly curved corner portion, and
an fourth convexly curved corner portion, said first and second corner portions each connecting a respective broad side face to a same narrow side face, said third and fourth corner portions each connecting a respective broad side face to the other narrow side face, said handle being characterized in that for a gripping part of the handle for being gripped by a user, said first and second corner portions each have a radius of curvature greater than the radius of curvature of each of the third and fourth corner portions.

Thus, in accordance with the present invention, a hockey stick (as broadly defined hereinabove) may be provided with a shaft or handle wherein the palm or upper side of the shaft has corner edges whose radius of curvature, at least in the grip area(s), is greater than the radius of curvature in the corresponding finger area(s); a hockey stick provided with such a handle may provide a sense of a better or more comfortable feel on the gripped portion of the handle and/or a sense of a more comfortable and precise control of a blade which may be fixed to the end of such a handle, as compared with a hockey stick the handle of which is provided with (known) traditional corner portions which are identical to each other.

In accordance with the present invention, the arc of the convexly curved corner portions may each be the same or different and may take on any curved configuration such as for example a rounded configuration, an elliptical configuration, etc.. The arcs of all of the convexly curved corner portions are preferably of the same configuration and preferably of rounded configuration (i.e. they have the configuration of an arc of a circle).

In accordance with the present invention, a corner portion may merge tangentially or non-tangentially with the broad and narrow side faces connected thereto. Thus, for example, if the corner portions are rounded, each rounded corner portion may merge tangentially with the broad and narrow faces connected thereto.

In accordance with the present invention the second corner portion may have the same or different radius of curvature as the first corner portion and the fourth corner portion may have the same or different radius of curvature as the third corner portion.

The radii of curvature of the aforementioned first and second corner portions, can have any number of values which provide the desired (enhanced) comfort and/or feel on the palm area of the hands. The actual value of the radii of curvature desired to be used must, however, of course, be such that the (effective) value of the radii of curvature of the first and second curve portions are greater than the (effective) value of the radii of curvature of the third and fourth corner portions.

It should be noted, however, that the possibility that the structure of the handle may be weakened increases as the radius of curvature increases. Accordingly, if relatively large radii of curvature are desired it may become necessary to take steps to reinforce the structure of the handle in any suitable (known) manner, e.g. by the use of a fiberglass/resin composite reinforcement layers, by appropriate choice of material of construction or the like. Keeping the above in mind, the radii of curvature of the first and second corner portions may, for example, have a value of 8 mm or less; the radii of curvature of the third and fourth corner portions may, for example, have a value of 5 mm or less.

The ratio of the radius of curvature of the first (or second) corner portion to the radius of curvature of the third (or fourth) corner portion may, for example, be in the range of from about 1.1 to about 1.65 or more.

The radius of curvature of the first corner portion and of the second corner portion may, for example, each be from about 5.0 mm to about 6.35 mm, the third and fourth corner portions having radii of curvature taking values less than those assigned to the radii of curvature of the first and second portions. The radii of curvature of the third corner portion and the fourth corner portion may, for example, each be from about 3.8 mm to about 4.5 mm.

In accordance with the present invention the broad and narrow side faces may each be planar (i.e. more or less flat in configuration).

In the figures which illustrate an example embodiment of the present invention,

FIG. 1 is a perspective view of a hockey stick having a shaft in accordance with the present invention;

FIG. 2 is an oblique view of the upper end portion of the hockey stick shaft shown in FIG. 1;

FIG. 3 is a cross-sectional view corresponding to the cross-section at line A—A in FIG. 1; and FIG. 4 is a schematic view showing the position of the stick when gripped by a user.

Referring now to FIG. 1, a hockey stick 1 is shown which comprises an upper elongated shaft or handle 2 which is attached to a blade 3. Apart from the configuration of the longitudinally extending corners (as shall be described hereinafter), the shaft 2 and the blade 3 ma be of conventional wood or plastic construction fixed together in any (known) manner.

Shaft 2, as can be seen, is a straight elongated member. The shaft 2 has a rectangular configuration (i.e. viewed in cross-section, the shaft 2 provides a more or less rectangular aspect—see FIG. 3).

Referring to FIGS. 1, 2 and 3, the shaft 2 includes a pair of opposed (planar) broad side faces 4 and 5.

The shaft 2 is also provided with a pair of opposed (planar) narrow side faces 6 and 7.

As shown in the cross-sectional view of FIG. 3, the upper narrow side face 7 is interconnected or joined with the broad side faces 4 and 5 by respective (rounded) corner portions 8 and 9 (i.e. the first and second corner portions). Similarly, the other narrow side face 6 is joined to the broad side wall faces 4 and 5 by the (rounded) corner portions 10 and 11 (i.e. the third and fourth corner portions).

The radius of curvature for each of the corner portions 8 and 9 are respectively indicated by the reference numerals 12 and 13. The radius of curvature for each of the other corner portions 10 and 11 are also respectively indicated by the reference numerals 14 and 15. It is to be noted that in FIG. 3 only one of the three arrows denoting the radius of curvature (of each of the corner portions) is so referenced; all three arrows however delineate the arc of the curved portions.

In the embodiment as shown in FIG. 3 the radii of curvature 12 and 13 are the same; similarly the radii of curvature 14 and 15 are also the same. However, the (effective) value of each of the radii of curvature 12 and 13 is greater than the (effective) value of either of the radii of curvature 14 and 15.

As seen in the cross-sectional view of FIG. 3, the corner portions 8, 9, 10 and 11 are each rounded and each merges in tangential fashion with the respective narrow and broad faces connected thereto. For example, the rounded corner portion 9 merges tangentially with the narrow face 7 and the broad face 5 connected thereto; the rounded corner portion 10 merges tangentially with the narrow face 6 and the broad face 5 connected thereto; the other corner portions 8 and 11 merge in similar fashion with the respective narrow and broad faces connected thereto.

The corner portions 8 and 9, as well as the narrow side face 7 extending therebetween, define a palm rest (see FIG. 4) on what may be considered the top or upper part of the handle when the blade is attached thereto.

The radii of curvature 12 and 13, of the aforementioned corner portions 8 and 9, can have any number of values which provide the desired enhanced comfort and feel on the palm area of the hands. The actual value of the radii of curvature desired to be used must, however, as mentioned above, be such that the values of the radii of curvature of the curved corner portions 8 and 9 are each greater than the value of the radii of curvature of the other curved corner portions 10 and 11.

If desired, the radii of curvature 12 and 13 may be the same or different provided that they are each greater than the either of the radii of curvature 14 and 15. Preferably, however, the radii of curvature 12 and 13 for the corner portions 8 and 9 are the same (i.e. have the same value). Similarly, the curve portions 10 and 11 may have radii of curvature 14 and 15 which are the same or different; preferably the radii of curvature 14 and 15 also have the same value.

For example, the ratio of the value of the radius of curvature 12 (or 13) and the value of the radius of curvature 15 (or 14) may vary from between about 1.1 to about 1.65 (e.g. the ratio=the value of the radius of curvature 12 divided by the value of the radius of curvature 15). In particular, for example, the radius of curvature 12 (or 13) may have a value of from about 5.0 mm to about 6.35 mm; the radius of curvature 15 (or 14) may have a value varying from about 3.85 to 4.5 mm. By way of example, the radii of curvature 12 and 13 may each be 6.35 mm and the radii of curvature 14 and 15 may each be 3.85 mm.

From the foregoing, it can be appreciated that the palm rest area of the shaft 2, is defined by the corner portions 8 and 9 as well as the narrow side wall face 7, providing a comfortable hand grip fit into the palm when the stick is being gripped by the user.

In the embodiment shown in the FIGS. 1 to 4, the corner portions 8 and 9 extend more or less the entire length of the handle component, namely from the top 16 of the shaft 2 to a point designated generally by the reference numeral 17. The rounded corner portions having the larger radii of curvature need not, of course, extend the full length such as indicated in FIG. 1. The rounded corner portions having the larger radii of curvature may, for example, be limited to a particular area or areas of the upper (or top) part of the shaft in accordance with the desires of an end-user.

Referring to FIG. 4, as may be seen the rounded corners of the top or palm rest area of the handle rests (comfortably) up against the palm area of the hands of a user. The bottom or finger area of the handle is cradled in the seat defined by the fingers for providing the user with a precise feel of the shaft for control of any blade (not shown) disposed at the end thereof.

A handle in accordance with the present invention may be made of any suitable (known) material. It may, for example, be made of wood, of a light metal such as aluminum, of a composite material (e.g. a fiberglass composite, a wood/fiberglass composite, a graphite composite or the like), etc. A handle of the present invention may, for example, be formed by first forming a hockey stick shaft with more or less squared corner portions and thereafter shaving or sanding the corner portions to the desired arc configuration as described herein. Alternatively, if the handle is to be of a plastic or similar material the moulding process (i.e. mold) may take into account the desired curved corner portions as described herein,

I claim:

1. An elongated handle of rectangular configuration, for a hockey stick, said handle having one end adapted to be attached to a hockey stick blade a pair of opposed broad side faces, a pair of opposed narrow side faces, a first convexly curved corner portion, a second convexly curved corner portion, a third convexly curved corner portion, and an fourth convexly curved corner portion, said first and second corner portions each connecting a respective broad side face to a same narrow side face, said third and fourth corner portions each connecting a respective broad side face to the other narrow side face, said handle being characterized in that for a gripping part of a handle for being gripped by a user, each of the broad and narrow side faces has a planar configuration, each of said corner portions has a rounded configuration, and said first and second corner portions each have a radius of curvature greater than the radius of curvature of each of the third and fourth corner portions.

2. An elongated handle as defined in claim 1 wherein each rounded corner portion merges tangentially with the broad and narrow side face connected thereto.

3. An elongated handle as defined in claim 1 wherein the radius of curvature of the first corner portion is from about 5.0 mm to about 6.35 mm and wherein the radius of curvature of the second corner portion is from about 5.0 mm to about 6.35 mm.

4. An elongated handle as defined in claim 3 wherein the radius of curvature of the third corner portion is from about 3.8 mm to about 4.5 mm and the radius of curvature of the fourth corner portion is from about 3.8 mm to about 4.5 mm.

5. An elongated handle as defined in claim 3 wherein each rounded corner portion merges tangentially with the broad and narrow side face connected thereto.

6. An elongated handle as defined in claim 1 wherein the second corner portion has the same radius of curvature as the first corner portion.

7. An elongated handle as defined in claim 6 wherein the fourth corner portion has the same radius of curvature as the third corner portion.

8. An elongated handle as defined in claim 6 wherein each rounded corner portion merges tangentially with the broad and narrow side face connected thereto.

9. An elongated handle as defined in claim 7 wherein the ratio of the radius of curvature of the first corner portion to the radius of curvature of the third corner portion is in the range of from about 1.1 to about 1.65.

10. An elongated handle as defined in claim 9 wherein each rounded corner portion merges tangentially with the broad and narrow side face connected thereto.

11. An elongated handle as defined in claim 7 the radius of curvature of the first corner portion is from about 5.0 mm to about 6.35 mm and the radius of curvature of the third corner portion is from about 3.8 mm to about 4.5 mm.

12. An elongated handle as defined in claim 11 wherein each rounded corner portion merges tangentially with the broad and narrow side face connected thereto.

* * * * *